United States Patent [19]

Fleischer et al.

[11] Patent Number: 4,630,655

[45] Date of Patent: Dec. 23, 1986

[54] STORAGE TANK FLOW CONTROL VALVE ASSEMBLY

[75] Inventors: Donald W. Fleischer, Wethersfield; Bruno S. Smilgys, Hartford, both of Conn.

[73] Assignee: Veeder Industries, Inc., Hartford, Conn.

[21] Appl. No.: 791,056

[22] Filed: Oct. 24, 1985

[51] Int. Cl.[4] ..... B65B 3/04

[52] U.S. Cl. ..... 141/198; 141/205; 141/311 R

[58] Field of Search ..... 141/98, 192–229, 141/311 R

[56] References Cited

U.S. PATENT DOCUMENTS 1,689,066 10/1928 Baxter ..... 141/205

2,811,179 10/1957 Greenwood ..... 141/205

*Primary Examiner*—Houston S. Bell, Jr.

*Attorney, Agent, or Firm*—Prutzman, Kalb, Chilton & Alix

[57] ABSTRACT

A passive flow control valve assembly for controlling the flow of fuel through the fill pipe of an underground fuel storage system is disclosed comprising a valve housing mounted to the discharge end of the fill pipe, a valve assembly for controlling flow through the housing which is mounted for movement between a first open position permitting substantially unrestricted flow through the housing and at least a second position substantially restricting the flow through the housing, an actuator arm assembly for moving the valve between the first and second positions with the actuator arm being interconnected to the valve so as to progressively correspondingly move the valve from the first open position to the second closed position as the actuator arm moves from a first position to a second position, and a float assembly connected to the actuator arm for moving the arm responsive to the liquid level in the storage tank.

15 Claims, 4 Drawing Figures

STORAGE TANK FLOW CONTROL VALVE ASSEMBLY

BACKGROUND AND SUMMARY OF THE INVENTION

This invention relates generally to underground fuel storage systems and particularly to a flow control valve assembly for the fill tube of an underground fuel storage tank.

In refilling underground fuel storage tanks such as the type commonly employed in gasoline filling stations, the supply hose from a tanker truck is coupled to the fill pipe of the underground storage tank and the fuel is gravity fed into the tank. In such systems, the fuel continues to flow unabated from the tanker truck until the tanker truck is empty, the operator closes the discharge valve on the tanker truck or until the storage tank is completely full thereby stopping any further flow. Since there is generally no means for alerting the operator that the storage tank is approaching a filled condition, the storage tank would be filled to capacity if the tanker truck initially contains more fuel than the unfilled capacity of the storage tank to be filled. Consequently, the discharge hose of the tanker truck is also filled with fuel which then presents a disposal problem. Typically, a filled supply hose may hold 25 gallons of fuel. Also, unless all of the pipe fittings are fuel-tight, the pressure exerted by the added head of fuel will cause these fittings to leak causing potential soil contamination.

Accordingly, it is an object of the present invention to provide a passive flow control valve which progressively reduces the flow of fuel into the tank as the quantity of fuel in the tank approaches a predetermined level in order to alert the tanker truck driver to the possible imminent overfilling of the storage tank and to allow the driver sufficient time to stop the flow of fuel.

Another object of the invention is to provide such a control valve which allows a small rate of flow when the valve is in the fully closed position so that any fuel contained in the supply hose may be drained into the storage tank.

Another object of the invention is to provide a passive flow control valve which can be retrofitted to existing fuel storage systems with minimum expense, labor, and structural modifications to existing fuel storage systems.

A further object of the invention is to provide such a passive flow control valve which is reliable in use, durable in construction, and economical to manufacture.

Other objects will be in part obvious and in part pointed out more in detail hereinafter.

The invention accordingly consists in the features of construction, combination of elements and arrangement of parts which will be exemplified in the construction hereafter set forth and the scope of the application which will be indicated in the appended claims.

DESCRIPTION OF THE PREFERRED EMBODIMENT

Figure 1:
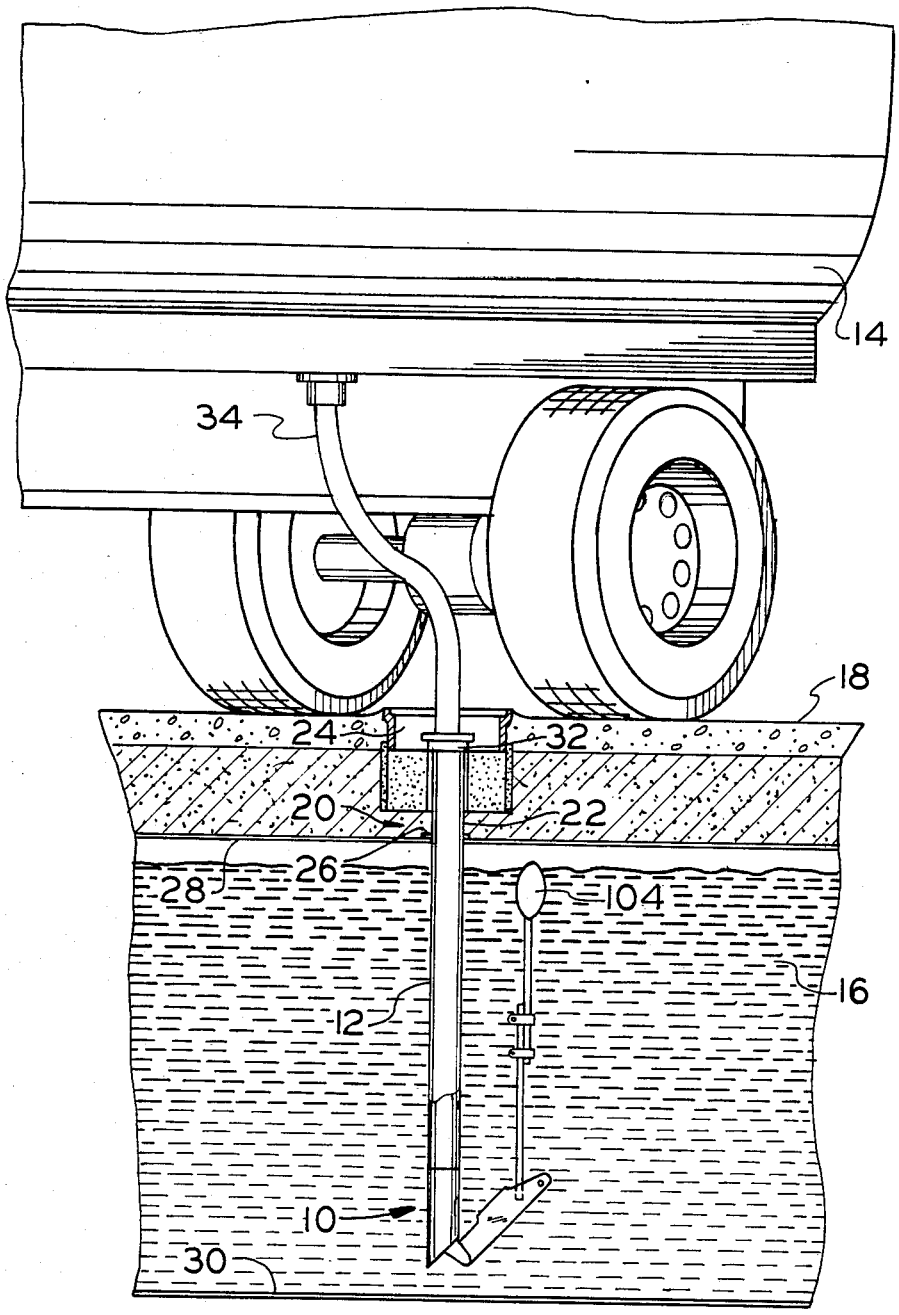
FIG. 1 is a diagrammatical view, partly broken away and partly in section, of an underground fuel storage system employing the flow control valve of the present invention.

Referring to the drawings in detail, the flow control valve assembly of the present invention is generally designated by the numeral 10 and is shown in FIG. 1 operationally mounted to the discharge end of the fill tube 12 of a typical underground fuel storage system.

For purposes of explanation, a portion of a conventional underground fuel storage system is showh in FIG. 1 in a refilling mode connected to a tanker truck 14. The underground fuel storage system includes a subsurface fuel storage tank 16 positioned below a reinforced concrete slab 18 at ground level. A filler pipe assembly 20 connects the interior of the storage tank 16 to ground level for purposes of refilling the storage tank. The filler pipe assembly 20 includes a riser pipe 22 connected to a bushing 26 mounted in an inlet aperture in the top wall 28 of the tank 16 and extending vertically to a manhole 24 in the concrete slab 18. When the tank is not being refilled, a removable cover (not shown) covers the manhole.

A fill tube 12 is mounted within the riser 22 and extends from the top of the riser to approximately six inches from the bottom wall 30 of the tank 16. The upper end of the fill tube 12 has a flange for coupling to the connector 32 on the terminal end of the supply hose 34 of the tanker truck 14 in a conventional manner. Generally, the fill tube 12 and the supply hose 34 are four inch nominal pipe size. The fuel from the tanker truck 14 is gravity fed through the hose 34 into the storage tank 16 and, with a four inch nominal pipe size supply hose and fill tube, the filling rate is approximately 400 gallons per minute.

Figure 2:
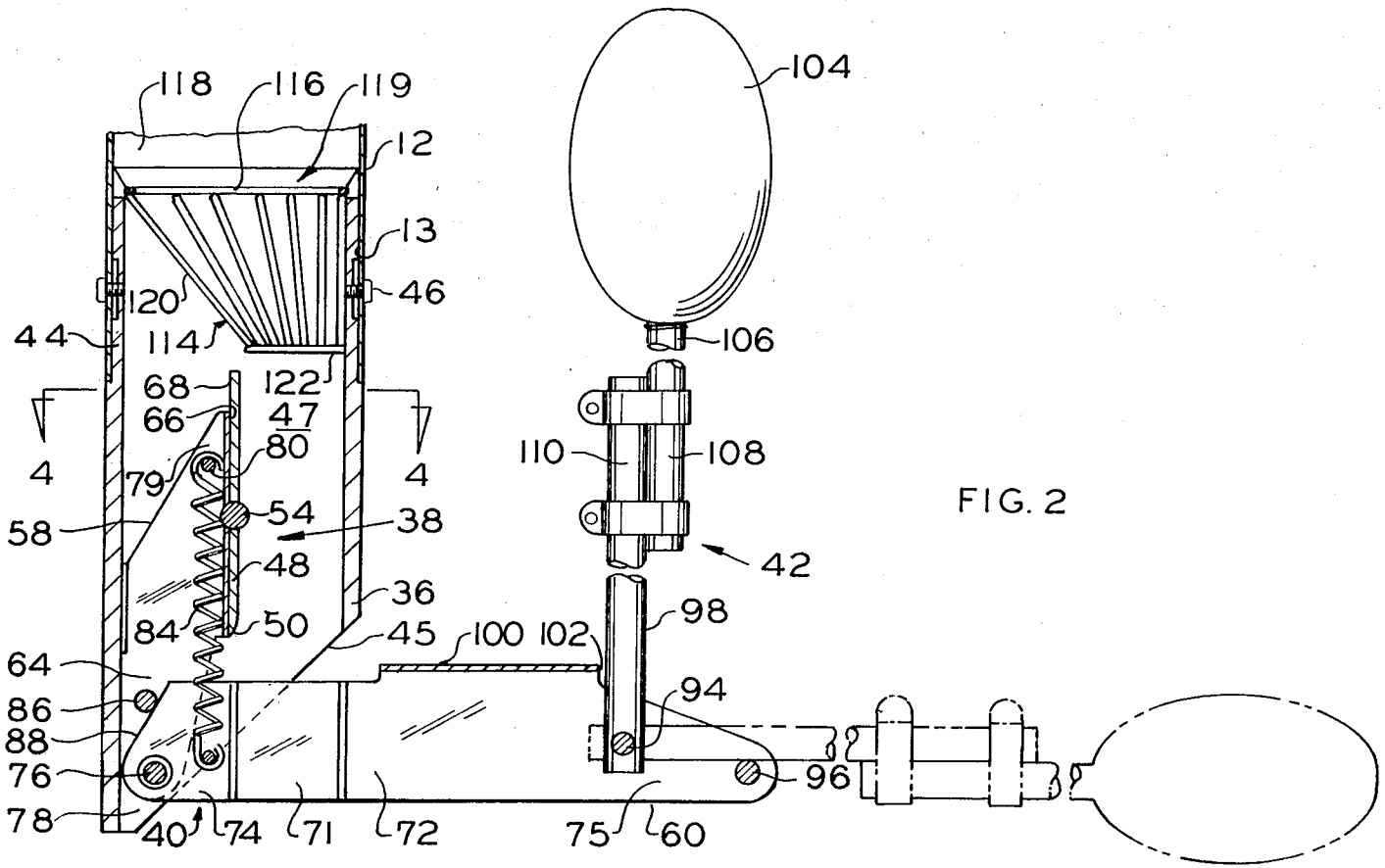
FIG. 2 is a longitudinal sectional view of the flow control valve assembly with the valve in the open position.

Referring to FIG. 2, the flow control valve assembly 10 generally comprises a cylindrical annular housing 36, a butterfly valve assembly 38 for controlling the flow of fluid through the housing 36, a valve actuator arm assembly 40 and a float assembly 42.

The cylindrical housing 36 has a recessed upper end 44 dimensioned for telescopic mounting within the lower end 13 of the fill tube 12. Screws 46 secure the upper end 44 of the housing 36 within the lower end 13. The bottom edge 45 of the housing 36 is inclined to form a protective housing for the actuator arm assembly 40 yet allow unencumbered operational pivotal movement thereof as explained in more detail hereinafter.

The housing 36 forms an interior cylindrical linear passageway 47 in coaxial alignment with the fill tube 12. For a 4 inch nominal pipe size fill tube the housing 36 is preferably dimensioned to provide a $3\frac{1}{2}$ inch inside diameter. The butterfly valve assembly 38 is pivotally mounted within the passageway 47 for movement between a first open position (FIG. 2) permitting substantially unrestricted flow through the housing 36 and a second closed position (FIG. 3) allowing a predetermined minimal flow through the housing.

Figure 3:
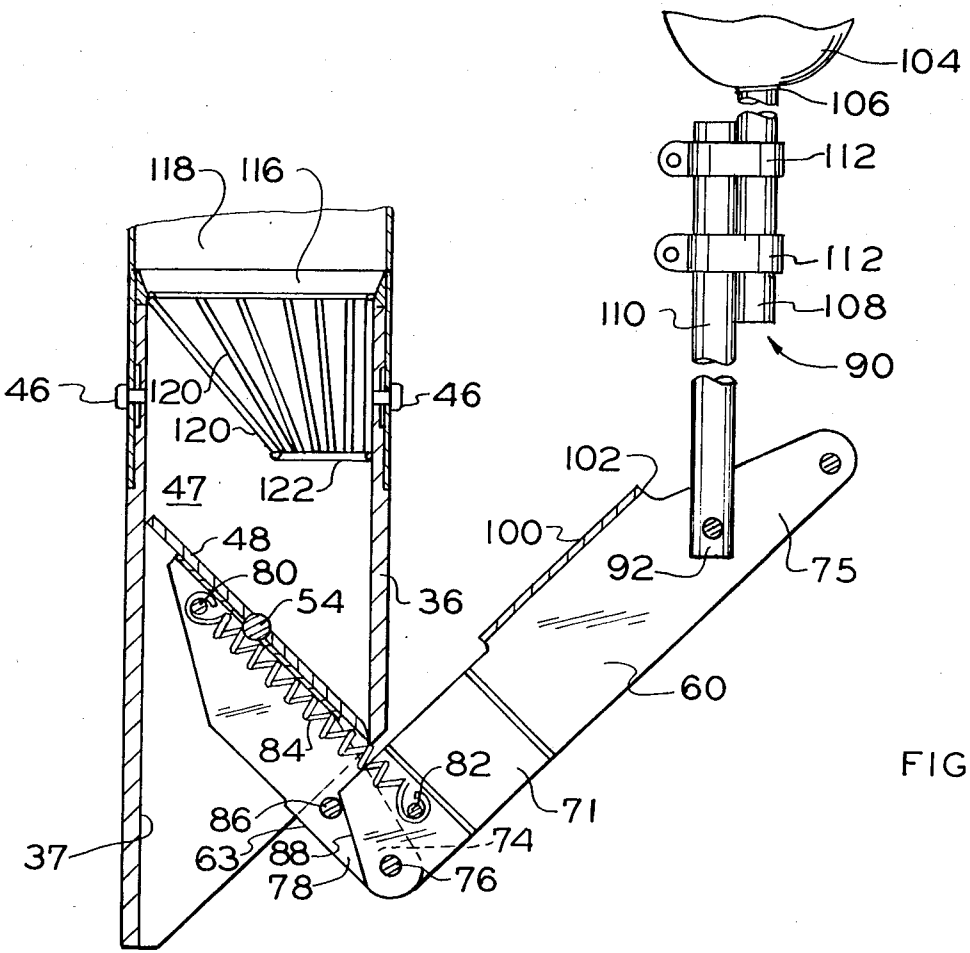
FIG. 3 is a longitudinal sectional view similar to FIG. 2 with the valve in the closed position.

The butterfly valve assembly 38 includes a generally elliptical flat valve plate 48 with a rounded end 50. The plate 48 is securely mounted by threaded fasteners (not shown) to a pivot shaft 54. The pivot shaft 54 is pivotally mounted to the housing 36 for pivotal movement about a diametral pivot axis within the passageway 47 so that the plate 48 is pivotal between open and closed positions. The elliptical shape of the plate 48 is dimensioned and configured to seat against the interior cylindrical surface of the housing 36 in the closed position as shown in FIG. 3 to substantially limit the flow of fuel through the housing 36. Preferably, the butterfly valve assembly 38 is configured so that the flow rate through the housing 36 is approximately 10 g.p.m. for a conventional 4 inch nominal pipe size fill tube, i.e., 2.5% of the peak flow rate of 400 g.p.m. Alternately, the butterfly valve assembly may be configured to substantially stop flow when the plate 48 is in the closed position. In the open position, the longitudinal axis of the elliptical plate 48 is approximately concurrent with the axis of the cylindrical passageway 47 as shown in FIG. 4.

The valve plate 48 is securely connected by threaded fasteners (not shown) to the actuator arm assembly 40. The arm assembly 40 comprises first and second pivotally interconnecting levers 58, 60. The lever 58 has opposing sidewalls 62, 64 with a planer top wall 66 seating the planer lower surface 68 of the valve plate 48. The first lever 58 is securely mounted to the top wall 66 of the valve plate 48 so that the valve plate 48 and the lever 58 pivot in unison with the pivot shaft 54. The lower edges 63 of the side walls 62, 64 are configured to engage the interior surface 37 of the housing 36 to prevent clockwise pivotal movement of the plate 48 (as viewed in FIG. 2) past the open position.

Figure 4:
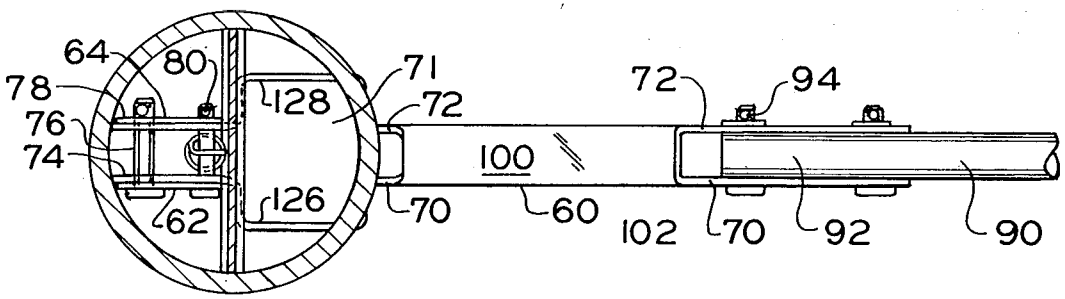
FIG. 4 is a transverse sectional view seen on line 4—4 of FIG. 2.

The second lever 60 has opposed parallel sidewalls 70, 72 spaced at one end 74 so as to be received between the sidewalls 62, 64 of the end 78 of the first lever 58 as shown in FIG. 4. A pivot connector pin 76 pivotally connects the end 74 of the lever 60 to the end 78 of the lever 58 to permit relative pivotal movement of the levers 58, 60. A spring mounting stud 80 is mounted at the end 79 of the lever 58 and extends between the sidewalls 62, 64. Similarly, a spring mounting stud 82 is mounted at the end 74 of the lever 60 and extends between the sidewalls 70, 72. A compression spring 84 is disposed between the sidewalls 62, 64 of the lever 58 and the sidewalls 70, 72 of the lever 60 and is connected to the studs 80, 82 to bias the lever 60 counterclockwise (as viewed in FIG. 2). The end 78 of the lever 58 has a stop pin 86 extending between the sidewalls 62, 64 and positioned so as to abut the lateral edge 88 of the lever 60 when the levers 58, 60 are approximately orthogonal. Accordingly, the spring 84 normally biases the lateral edge 88 against the stop pin 86 to maintain the lever 58 approximately orthogonal to the lever 60.

The float assembly 42 is connected to the actuator arm assembly 40 to pivot the levers 58, 60 responsive to the level of fuel in the tank 16. The float assembly 42 comprises a length-adjustable rod 90 interconnecting the lever 60 to a float 104. The rod 90 is pivotally mounted at its lower end 92 to the outer end 75 of the lever 60. The lower end 92 of the rod 90 is disposed between the opposing sidewalls 70, 72 and is pivotally interconnected thereto by the pivot pin 94. A stop pin 96 extends between the sidewalls 70, 72 to abut the side 98 of the rod 90 to limit the clockwise pivotal movement (as viewed in FIG. 2) of the rod 90. The lever 60 also has a top wall 100 extending between the sidewalls 70, 72 with a lateral edge 102 disposed towards its outer end 75. The lateral edge 102 is positioned so as to form an abutment stop to the counterclockwise pivotal movement of the rod 90 (as viewed in FIG. 2) when the rod 90 reaches a vertically aligned orientation. Thus, the stop pin 96 and the lateral edge 102 limit the pivotal arc of the rod 90 to approximately 90°.

The float 104 is mounted to the upper end of the rod 90 and includes a sealed threaded bore (not shown) for detachable securement to the threaded upper end 106 of the rod 90. The rod 90 includes an upper section 108 and a lower section 110 adjustably selectively connected by clamps 112. Clamps 112 are generally of conventional design and permit the effective length of the rod 90 to be selectively adjusted to accommodate underground tanks of various heights. Preferably, the upper and lower sections are ¼ inch aluminum rod.

Generally, the precise level of fuel in the tank 16 is measured by a measuring stick inserted into the tank 16 through the fill tube 12. In order to facilitate insertion of the measuring stick and prevent damage to the butterfly valve assembly 38, a wire basket guide 114 is mounted to the upper end 44 of the housing 36. The guide 114 comprises a cylindrical wire rim 116 coaxially secured to a beveled ring insert 118 mounted to the top of the housing 36. The bevelled edge 119 of the insert 118 extends radially inwardly and downwardly. A plurality of wire elements 120 extend generally downwardly from the rim 116 to the right-hand side of the passageway 47 (as viewed in FIG. 2) and terminate so as to form an opening 122 longitudinally aligned with the passageway 47 but offset from the center line thereof. The wire guide 114 will permit fuel to flow freely therethrough and will direct a measuring stick inserted through the filler pipe assembly 20 to pass through the right hand portion of the housing 36 so as not to injure the butterfly valve assembly 38 irrespective of the position of the valve plate 48 at the time of insertion of the measuring stick. If the valve plate 48 should be in a partially closed or closed position upon insertion of the measuring stick, the measuring stick will simply contact the right hand side of the valve plate 48 and rotate the valve plate 48 clockwise toward the open position.

Referring to FIG. 4, the opposing portions 126, 128 of the sidewalls 70, 72 of the lever 60 form a generally rectangular cross-sectional opening 71 therebetween which is disposed so as to be in vertical alignment with the opening 122 of the guide 114 when the valve plate 48 is pivoted to the open position. Consequently, the measuring stick will have an unobstructed linear vertical path to the bottom of the tank. That is, upon insertion of the measuring stick into the filler pipe assembly when the valve plate 48 is in a closed or partially closed position, the guide 114 will direct the stick into the right hand portion of the passageway 47 and the stick will contact and pivot the valve plate 48 toward the open position. The lever 60 will consequently also be pivoted into the relative orthogonal position of FIG. 3 so that the opening 71 is in direct vertical alignment with the opening 122 thereby allowing the measuring stick to pass vertically through the opening 71 to the bottom wall of the storage tank. The rounded end 50 of the plate 48 facilitates easy removal of the measuring stick.

In retrofitting an existing underground fuel storage system, the fill tube 12 is first withdrawn from the riser pipe 22 and tank 16. The lower end of the fill tube 12 is cut off to compensate for the additional length attendent the attachment of the flow control valve assembly 10 to the fill tube 12 so that discharge end of the housing 36 is at the preferable distance of approximately six inches from the bottom wall 30 of the storage tank. The upper end 44 of the housing 36 is slidably inserted within the discharge end 13 of the fill tube 12. The self tapping screws 46 are inserted radially inwardly through the lower end 13 and the upper end 44 for a secure interconnection.

The effective length of the float rod 90 is adjusted to accommodate the height of the particular storage tank so that the flow control valve begins to close at a preselected level. The rod 90 with the float 104 attached thereto and the actuator arm assembly 40 are manually pivoted (clockwise as viewed in FIG. 2) against the bias of spring 80 into concurrent alignment with the longitudinal axis of the fill tube 12 and the housing 36. The fill tube 12 is reinserted into the tank through th riser pipe 22 with the float 104 being first inserted through the riser pipe 22. Since the rod 90 and the actuator arm assembly 40 are in linear alignment, the flow control valve assembly 10 is easily inserted through the riser pipe 22. Upon emergence of the flow control valve assembly 10 into the storage tank 16, the spring 80 will pivot the lever 60 into its desired position and the rod 90 and float 104 will assume a position dictated by the fuel level in the storage tank. The fill tube 12 is then reattached to the riser pipe 22. Thus, an existing underground fuel storage system is conveniently and economically retrofitted with the flow control valve assembly 10 of the present invention with a minimum of expense, labor, and modification to the existing system. Only the end of the fill tube 12 need be modified, i.e., shortened, for purposes of retrofitting the flow control valve assembly 10 to an existing system.

In the refilling operation, the connector 32 of the supply hose 34 of a tanker truck 14 is coupled to the fill tube 12 as shown in FIG. 1. The supply valve (not shown) on the tanker truck is opened to allow the gravity flow of fuel into the tank 16. As can be appreciated, the flow of fuel through a four inch supply line at a rate of 400 gallons per minute generates a distinctive audible sound.

It is assumed for purposes of explanation herein that the level of fuel in the tank is sufficiently low that the rod 90 is resting in the stop pin 26 in a generally horizontal position. As the level in the tank rises, the float 104 will rise with the fuel level and the rod 90 will correspondingly pivot counterclockwise (as viewed in FIG. 2). When the tank reaches a predetermined level wherein the arm 90 is vertical yet the actuator arm 60 remains horizontal, the flow control valve assembly is still in an open position as shown in FIG. 2 but will thereafter begin to progressively pivot counterclockwise (as viewed in FIG. 2) toward a closed position. Specifically, as the level of the fuel in the storage tank continues to rise, the float 104 will continue to rise and progressively pivot the lever 60 and the lever 58 counterclockwise causing the valve plate 48 to proportionately pivot counterclockwise toward the closed position. The valve plate 48 pivots towards the closed position proportionately to the rise of the float 104 thereby progressively reducing the flow rate of fuel into the tank. Preferably, the actuator arm assembly 40 has a throw of six inches between the open position of FIG. 2 and the closed position of FIG. 3. During the progressive closing of the valve plate 48, the sound emitted from the fuel flowing through the supply hose 34 to the tank 16 will noticeably change to alert the truck operator that the tank is approaching a filled condition. In the closed position of FIG. 3, the flow rate into the tank is preferably 10 gallons per minute. Such a flow rate is small in comparison to the normal size of conventional underground storage tanks and the effective height of the float rod 90 is preselected to allow sufficient reaction time for the operator to conveniently close the tanker truck supply valve prior to completely filling the tank. After the tanker truck valve is closed, the fuel remaining in the supply hose 34 is drained into the storage tank 16 since the flow control valve 10 in the closed position still permits limited flow into the storage tank.

As can be seen, the flow control valve of the present invention is passive and functions to progressively reduce the flow of fuel into the tank as the tank level approaches a predetermined amount and thereby provides an audible indication signal of the fuel level in the tank. The flow control valve is conveniently retrofitted to existing underground fuel storage systems and does not interfere with the normal measurement of fuel through the use of measuring sticks or the like.

As will be apparent to persons skilled in the art, various modifications and adaptations of the structure above described will become readily apparent without departure from the spirit and scope of the invention, the scope of which is defined in the appended claims.

We claim:

1. In combination, an underground fuel storage system comprising a fuel storage tank positioned below ground level and a fill pipe assembly extending from ground level into said tank for refilling said tank from a gravity feed tanker truck, said fill pipe assembly including a fill tube extending into said tank and having a discharge end within said tank, and a passive flow control valve assembly for controlling the flow of fuel through said fill pipe into said tank comprising a valve housing mounted to the discharge end of said fill pipe and having an upstream end and a downstream end, valve means pivotally mounted within said housing for controlling flow through said housing, said valve means having pivotally opposing sections and being pivotally moveable between a first open position permitting substantially unrestricted flow through said housing between said upstream and downstream ends and at least a second position substantially restricting flow through said housing between said upstream and downstream ends, actuator arm means for moving said valve means between said first and second positions, said actuator arm means being mounted for movement between first and second positions and being interconnected to said valve means so as to correspondingly move said valve means from said first position to said second position as said actuator arm means moves from said first position to said second position, wherein said valve means is releasably pivotally moveable from said second position in the direction of said first position to permit less restricted flow through said housing between said upstream and downstream ends than the corresponding flow at said second position upon application of a suitable force to a said valve means section in a direction generally toward said downstream end, and float means connected to said actuator arm means for moving said arm means to said second position when the liquid level of the storage tank reaches a predetermined level.

2. The combination of claim 1 wherein said valve means comprises a butterfly valve pivotally mounted within said housing for pivotal movement between a first open position permitting substantially unrestricted flow through said housing and a second position substantially restricting flow through said housing, said actuator arm means comprises an actuator arm mounted for movement between first and second positions and being interconnected to said butterfly valve so as to progressively pivot said butterfly valve from said first position toward said second postion in correspondence to the movement of said actuator arm from said first position toward said second position, and said float means being interconnected to said actuator arm so as to move said actuator arm from said first position to said second position when the fuel level in said storage tank moves from a first predetermined level to a second predetermined level, said second level being vertically higher than said first level, whereby the flow of fuel through said housing is progressively reduced as the level of fuel in said tank increases from said first predetermined level to said second predetermined level.

3. The combination of claim 2 wherein said float means comprises a linear rod having first and second ends with said first end being pivotally mounted to said actuator arm and a float mounted to said second end, the length of said linear rod being predetermined so that said linear rod is vertically orientated when the fuel level in said tank is at said first predetermined level.

4. The combination of claim 2 which comprises said butterfly valve having a valve plate pivotally mounted within said housing about a diametral axis for pivotal movement between a first open position and a second position, said plate having opposing end portions with a first end portion pivoting downwardly when said plate pivots from said second position to said first position and a second end portion pivoting upwardly when said plate pivots from said second position to said first position, and a guide means within said housing for guiding a measuring stick inserted through said housing toward said first end portion and away from said second end portion when said plate is in a position other than said first position.

5. The combination of claim 4 wherein said guide means comprises a wire basket guide mounted to said housing vertically above said valve plate.

6. The combination of claim 2 wherein said housing forms a flow passageway therethrough and said actuator arm is connected to said butterfly valve so as to extend generally transverse to said passageway when said valve is in said open position, said arm being comprised of first and second opposing plates spaced apart so as to form an opening for insertion of a measuring stick therethrough when said valve is in said open position.

7. The combination of claim 1 wherein said housing has a wall with an interior surface forming a cylindrical flow passageway therethrough with a longitudinal axis, said valve means comprises an elliptically shaped valve plate pivotally mounted within said passageway for pivotal movement about a diametral pivot axis between a first open position and a second position, said plate having a longitudinal axis and said axis being approximately concurrent with said longitudinal axis of said passageway when said plate is in said first position, said plate being dimensioned and configured relative to said passageway so as to seat against said interior surface of said passageway and substantially close off said passageway when said plate is in said second position to substantially reduce flow through said passageway.

8. A flow control valve assembly for retrofitting to the discharge end of a preinstalled removable fill tube of an underground fuel storage tank comprising a cylindrical valve housing adapted for coaxial mounting to the discharge end of a fill tube of an underground storage tank, said housing having an upstream end and a downstream end being dimensioned and configured for insertion through a conventional size fill pipe riser of an underground fuel storage tank while mounted to the discharge end of a fill tube, valve means for controlling the flow of liquid through said housing between said upstream and downstream ends, said valve means being pivotally mounted within said housing and being pivotally actuable between a first open position permitting substantially unrestricted liquid flow through said housing and at least a second partially closed position restricting liquid flow through said housing, and actuator float means for actuating said valve means to said second position upon the liquid level of the underground storage tank reaching a predetermined level, wherein said valve means is releasably pivotally moveable from said second position to permit less restricted liquid flow through said housing than the corresponding flow at said second position upon suitable application of a force to said valve means in the general direction of said downstream end, said float means being interconnected to said valve means and being dimensioned and configured for insertion through a conventional size fill pipe riser of an underground fuel storage tank while interconnected to said valve means.

9. The device of claim 8 wherein said actuator float means comprises an actuator arm means for moving said valve means between said first and second postions, said arm means being mounted for movement between first, second and third positions, said arm means being interconnected to said valve means so as to correspondingly move said valve means from said first position to said second position as said arm means moves from said first position to said second position, said third position generally linearly aligning said arm means with an attached fill pipe to permit insertion of the arm means through a riser pipe while interconnected to a fill pipe, and a float means connected to said actuator arm means for moving said arm means to said second position when the liquid level of the storage tank reaches a predetermined level.

10. The device of claim 8 wherein said actuator float means comprises an actuator arm means for moving said valve means between said first and second positions, said arm means being mounted for movement between first and second positions and being interconnected to said valve means so as to correspondingly move said valve means from said first position to said second position as said arm means moves from said first position to said second position, a length-adjustable rod having first and second ends, said first end being pivotally connected to said arm means, and a float mounted to the second end of said rod, said rod being selectively adjusted to have an effective length so that said float is operational to move said arm means to said second position when the liquid level of the storage tank reaches a predetermined level.

11. The device of claim 8 wherein said valve means comprises a butterfly valve pivotally mounted within said housing for pivotal movement between a first open position permitting substantially unrestricted flow through said housing and a second position substantially restricting flow through said housing, and said actuator float means comprises an actuator arm mounted for movement between first and second positions and being interconnected to said butterfly valve so as to progressively pivot said butterfly valve from said first position toward said second position in correspondence to the movement of said actuator arm from said first position toward said second position, and float means for moving said arm to said second position when the liquid level in a storage tank reaches a predetermined level and being interconnected to said actuator arm so as to move said actuator arm from said first position to said second position when the fuel level in the storage tank moves from a first predetermined level to a second vertically higher predetermined level so that the flow of fuel through said housing is progressively reduced as the level of fuel in said tank increases from a first predetermined level to a second predetermined level.

12. The device of claim 11 which comprises said butterfly valve having a valve plate pivotally mounted within said housing about a diametral axis for pivotal movement between a first open position and a second position, said plate having opposing end portions with a first end portion pivoting downwardly when said plate pivots from said second position to said first position and a second end portion pivoting upwardly when said plate pivots from said second position to said first position, and a guide means within said housing for guiding a measuring stick inserted through said housing toward said first end portion and away from said second end portion when said plate is in a position other than said first position.

13. The device of claim 12 wherein said guide means comprises a wire basket guide mounted to said housing vertically above said valve plate.

14. The device of claim 11 wherein said housing forms a flow passageway therethrough and said actuator arm is connected to said butterfly valve so as to extend generally transverse to said passageway when said valve is in said open position, said arm being comprised of first and second opposing plates spaced apart so as to form an opening for insertion of a measuring stick therethrough when said valve is in said open position.

15. The device of claim 8 wherein said housing has a wall with an interior surface forming a cylindrical flow passageway therethrough with a longitudinal axis, said valve means comprises an elliptically shaped valve plate pivotally mounted within said passageway for pivotal movement about a diametral pivot axis between a first open position and a second position, said plate having a longitudinal axis and said axis being approximately concurrent with said longitudinal axis of said passageway when said plate is in said first position, said plate being dimensioned and configured relative to said passageway so as to seat against said interior surface of said passageway and substantially close off said passageway when said plate is in said second position to substantially reduce flow through said passageway.

* * * * *